US009080808B2

(12) United States Patent
Choi et al.

(10) Patent No.: US 9,080,808 B2
(45) Date of Patent: Jul. 14, 2015

(54) REFRIGERATOR

(75) Inventors: Hojin Choi, Changwon-si (KR); Seokhoon Kang, Jinju-si (KR); Seongjin Kim, Busan (KR); Youngnam Kim, Changwon-si (KR); Sanghu Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 274 days.

(21) Appl. No.: 13/548,466

(22) Filed: Jul. 13, 2012

(65) Prior Publication Data

US 2013/0014533 A1 Jan. 17, 2013

(30) Foreign Application Priority Data

Jul. 14, 2011 (KR) ..... 10-2011-0069929

(51) Int. Cl.

| | |
|---|---|
| ***F25D 11/00*** | (2006.01) |
| ***F25D 23/04*** | (2006.01) |
| ***F25D 21/04*** | (2006.01) |
| ***F25D 23/02*** | (2006.01) |

(52) U.S. Cl.

CPC ..... *F25D 23/025* (2013.01); *F25D 21/04* (2013.01); *F25D 2323/023* (2013.01); *F25D 2400/06* (2013.01)

(58) Field of Classification Search

CPC . F25D 21/04; F25D 23/025; F25D 2323/023; F25D 2400/06

USPC ..... 62/275, 440, 449, 259.1; 312/236, 312/405.1

See application file for complete search history.

(56) References Cited

U.S. PATENT DOCUMENTS

| | | | | |
|---|---|---|---|---|
| 2,130,617 | A * | 9/1938 | Dockham | 312/291 |
| 2,150,064 | A * | 3/1939 | Robert et al. | 62/266 |
| 2,703,442 | A * | 3/1955 | Philipp | 312/405 |
| 3,747,361 | A * | 7/1973 | Harbour | 62/157 |
| 5,209,082 | A * | 5/1993 | Ha | 62/265 |
| 6,079,216 | A * | 6/2000 | de Marsillac Plunkett et al. | 62/56 |
| 8,147,015 | B2 * | 4/2012 | Kim et al. | 312/405 |
| 8,230,647 | B2 * | 7/2012 | Cho et al. | 49/501 |
| 8,544,973 | B2 * | 10/2013 | Kwon et al. | 312/405.1 |
| 2006/0143860 | A1 * | 7/2006 | Park et al. | 16/243 |
| 2006/0150661 | A1 * | 7/2006 | Kim et al. | 62/407 |
| 2006/0168890 | A1 * | 8/2006 | Cho | 49/193 |

(Continued)

FOREIGN PATENT DOCUMENTS

| | | | |
|---|---|---|---|
| CN | 2145966 | Y | 11/1993 |
| CN | 101317057 | A | 12/2008 |
| KR | 10-2006-0034112 | A | 4/2006 |

OTHER PUBLICATIONS

Chinese Office Action dated Apr. 30, 2014 issued in a related Application No. 201210229808.8.

*Primary Examiner* — Mohammad M Ali

(74) *Attorney, Agent, or Firm* — Ked & Associates, LLP

(57) ABSTRACT

A refrigerator is provided. The refrigerator may include a refrigerator body having at least one storage compartment and an opening, and a main door for opening and closing the storage compartment, the main door also having an opening corresponding to a receiving compartment formed therein. A sub door may be provided to open and close the opening of the main door, and a gasket may be provided along an edge of a rear surface of the sub door to contact a front surface of the main door and seal an interior of the main door when the sub door is closed. A heat transfer member may extend from the inside of a side to the inside of a front surface of the main door.

15 Claims, 7 Drawing Sheets

(56) References Cited

U.S. PATENT DOCUMENTS

2006/0226751 A1* 10/2006 Park ..... 312/405.1
2006/0248824 A1* 11/2006 Cho et al. ..... 52/205
2008/0053138 A1* 3/2008 Ryu et al. ..... 62/344
2008/0168794 A1* 7/2008 Cho et al. ..... 62/441
2009/0261701 A1* 10/2009 Yun et al. ..... 312/405
2010/0096040 A1* 4/2010 Litto ..... 141/95
2010/0147001 A1* 6/2010 Kim et al. ..... 62/259.1
2010/0154457 A1* 6/2010 Kim et al. ..... 62/340

* cited by examiner

REFRIGERATOR

CROSS-REFERENCE TO RELATED APPLICATION(S)

This application claims priority under 35 U.S.C. §119 to Korean Application No. 10-2011-0069929 filed on Jul. 14, 2011, whose entire disclosure is hereby incorporated by reference.

BACKGROUND

1. Field

This relates to a refrigerator, and more particularly, to a refrigerator including a main door and a sub door.

2. Background

Generally, an interior temperature of a refrigerator may be reduced/maintained cool air generated by a refrigeration cycle including a compressor, a condenser, an expansion valve, and an evaporator to store items in a frozen state or in a refrigerated state. For example, a refrigerator may include a freezer compartment for storing items in a frozen state and a refrigerator compartment for storing items at low temperature.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings. Wherever possible, the same reference numbers will be used throughout the drawings to refer to the same or like parts.

A refrigerator may be classified as a top mount type refrigerator in which a freezer compartment is disposed above a refrigerator compartment, a bottom freezer type refrigerator in which a freezer compartment is disposed under a refrigerator compartment, or a side by side type refrigerator in which a freezer compartment and a refrigerator compartment are partitioned by a partition wall so that the freezer compartment is vertically disposed at one side of the refrigerator and the refrigerator compartment is vertically disposed at the other side of the refrigerator. The refrigerator cools, such a freezer compartment and/or a refrigerator compartment using cool air generated through heat exchange with a refrigerant circulating in the refrigeration cycle. As a result, the interior of the refrigerator is generally maintained at a lower temperature than the outside.

The freezer compartment and the refrigerator compartment may be provided in a cabinet constituting a refrigerator body and may be selectively opened or closed by a freezer compartment door and a refrigerator compartment door, respectively rotatably mounted to the cabinet, with a gasket for providing sealing between each door and the cabinet. Since the interior temperature of the freezer compartment and the refrigerator compartment is lower than the temperature of external air, dew, or condensation/moisture, may be formed at the front of the cabinet, outside the portion thereof with which the gasket of each of the doors comes into contact, due to temperature difference between the inside and the outside of the refrigerator.

A heater may be installed at an area at which moisture is typically accumulated so that the area may be heated by the heater to prevent moisture/condensation from being formed at the outer surface of the refrigerator.

Additionally, a sub door may be provided at the refrigerator door to reduce leakage of cool air due to frequent opening and closing of the door and, in addition, to facilitate insertion and removal of items from the refrigerator. Such a sub door may open and close an opening formed at the front of the refrigerator door. When the refrigerator door may be closed, the sub door is opened and closed so that items may be stored in a basket formed at the inside of the sub door and removed from the basket.

Figure 1:
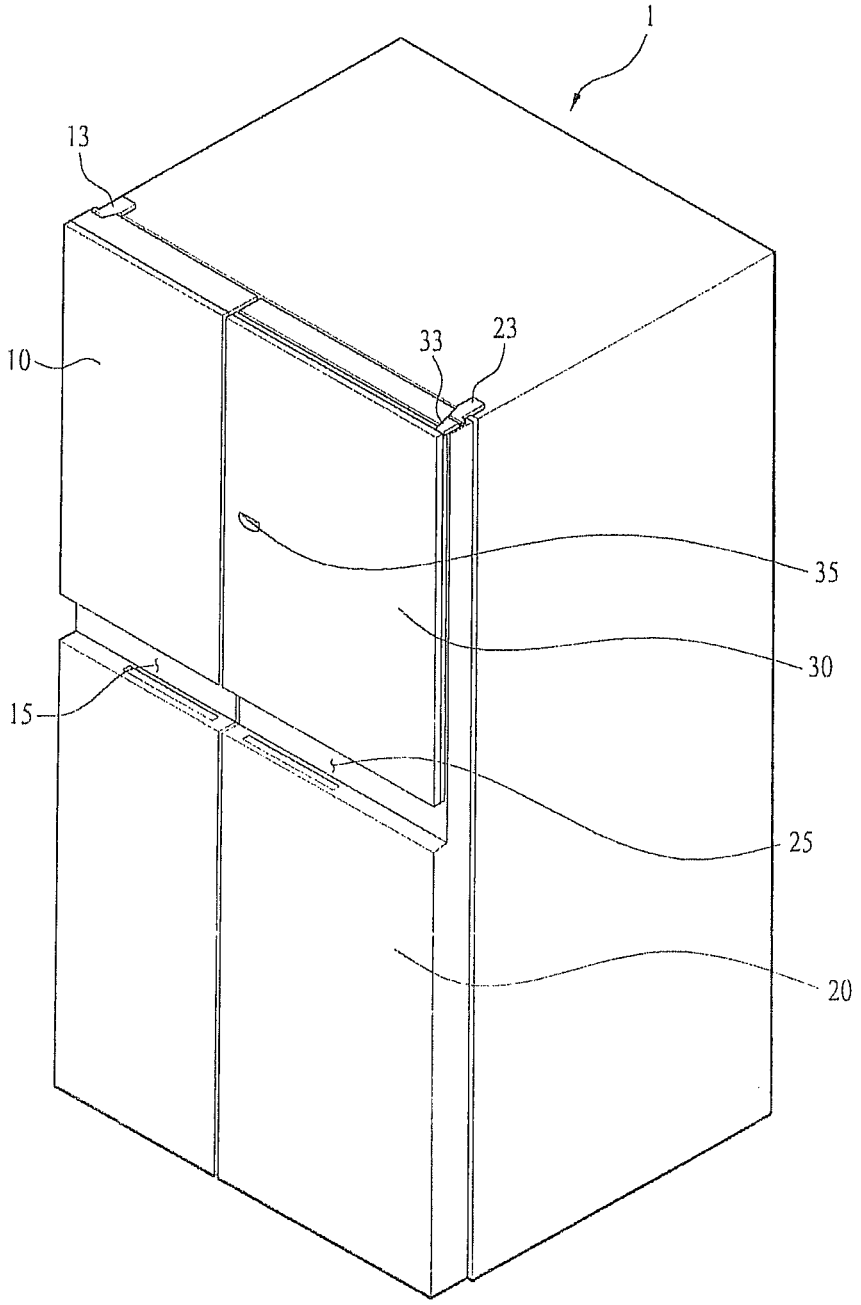
FIG. 1 is a perspective view of an exemplary side by side type refrigerator having a sub door.
Figure 2:
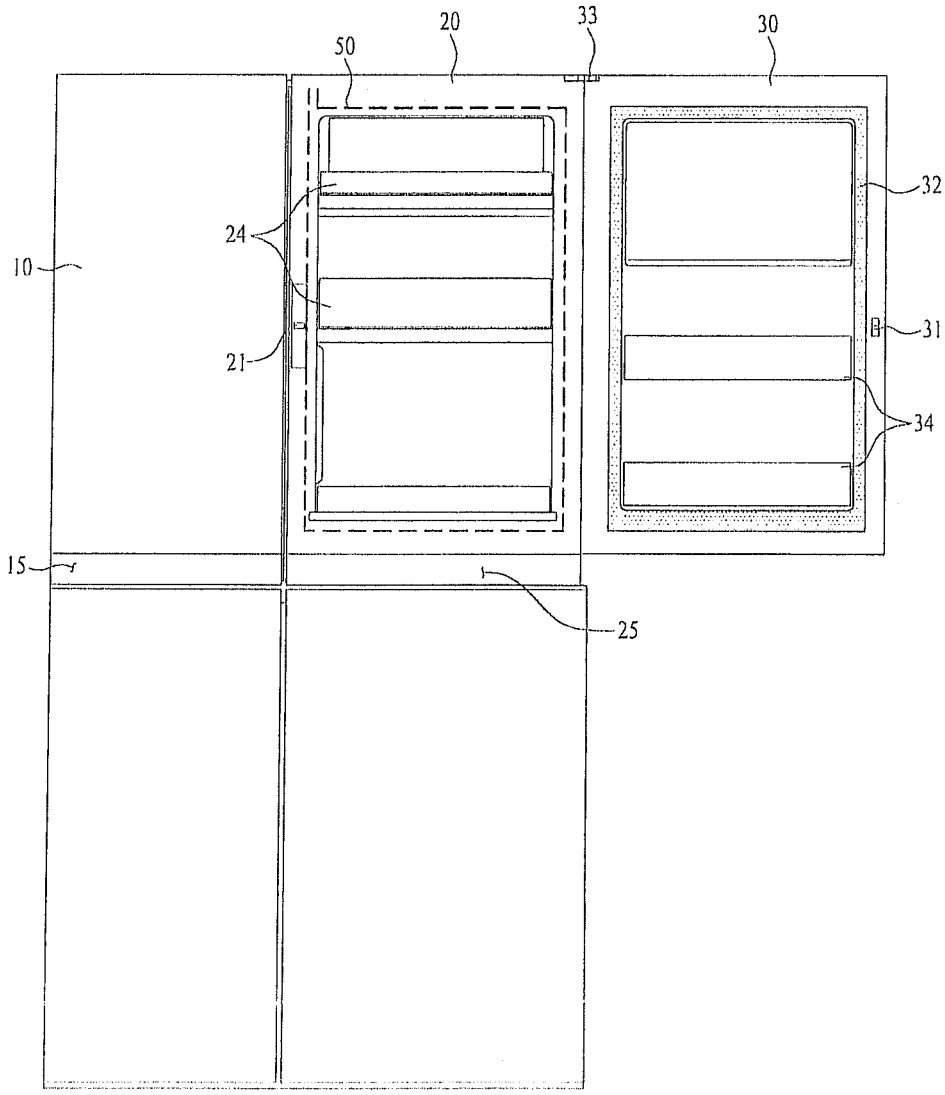
FIG. 2 is a front view of the refrigerator of FIG. 1 with the sub door open.

FIGS. 1 and 2 illustrate an exemplary side by side type refrigerator having a sub door. The sub door may be provided at a refrigerator compartment door. The size of the sub door may be less than that of the refrigerator compartment door. A receiving space may be defined in the sub door. This type of sub door may be called a 'home bar door.' In the example shown in FIG. 1, however, the width of the sub door is equal to that of the refrigerator compartment door to provide a relatively large receiving space therein. Such a sub door having a width equal to that of the refrigerator compartment door may be called a 'magic door.'

The refrigerator 1 is a side by side type refrigerator including a freezer compartment door 10 and a refrigerator compartment door 20 rotatably mounted to a refrigerator body by hinges 13 and 23 provided at the left and right upper ends of the refrigerator body so that a sub door 30 and the refrigerator compartment door 20 may rotate about the hinges 13 and 23. In other words, in the exemplary refrigerator shown in FIGS. 1 and 2, the refrigerator compartment door 20 is a main door, and the sub door 30 opens and closes an opening of the refrigerator compartment door 20.

The freezer compartment door 10 and the refrigerator compartment door 20 may include depressions 15 and 25 respectively formed at intermediate portions thereof, with grooves formed at the top and bottom of each of the depressions 15 and 25. When a push button 35 provided on the sub door 30 is pushed, the sub door 30 may be opened or closed by an opening and closing device 21 provided at the main door 20.

When the push button 35 is pushed, a protrusion 31 that protrudes from the inside of the sub door 30 may be inserted into or separated from a groove of the opening and closing device 21 to close or open the sub door 30.

As shown in FIG. 2, a plurality of shelves 24 may be arranged in a receiving space defined in the main door 20. A plurality of shelves 34 may be also arranged on the inside of the sub door 30.

A gasket may be provided along the edge of the inside of the sub door 30 for sealing a storage compartment defined between the main door 20 and the sub door 30. When the sub door 30 is closed, the gasket 32 comes into contact with the edge of the front part of the main door 20 to seal the storage compartment formed between the sub-door 30 and the main door 20. Condensation may be formed at the edge of the front part of the main door 20, outside the region thereof with which the gasket 32 comes into contact, due to temperature difference between internal air and external air.

In order to prevent condensation from forming/accumulating on the surface of the edge of the main door 20, an electric heating type heater 50 may be provided adjacent to the front surface of the main door 20.

Figure 3:
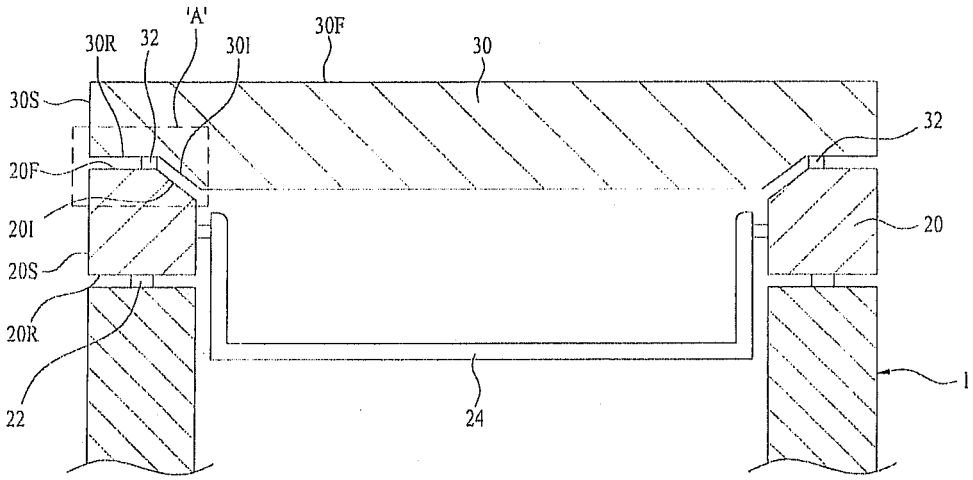
FIG. 3 is a horizontal cutaway sectional view of a refrigerator compartment of the refrigerator of FIG. 1.

FIG. 3 is a horizontal cutaway sectional view of the refrigerator compartment of the refrigerator shown in FIGS. 1 and 2.

As shown in FIG. 3, the main door 20 includes a rear surface 20R, a side surface 20S, and a front surface 20F such that a cross section of the main door 20 forms a quadrangle. A central portion of the main door 20 is opened, with the shelves 24 mounted in a space defined in the main door 20. The sub door 30 opens and closes the central opening formed in the main door 20. The sub door 30 also includes a rear surface 30R, a side surface 30S, and a front surface 30F.

The gasket 32 may be provided on the rear surface 30R of the sub door 30 so that the gasket 32 comes into contact with the front surface 20F of the main door 20 to seal the internal space. Another gasket 22 may be provided on the rear surface 20R of the main door 20 to seal the internal space when the gasket 22 comes into contact with the front part of the refrigerator body 1. A portion of the front surface 20F of the main door 20 may have an inclined surface 20I. The sub door 30 may also have an inclined surface 30I corresponding to the inclined surface 20I of the main door 20. As a result, a central portion of the sub door 30 may be thicker than the edge of the sub door 30.

Figure 4:
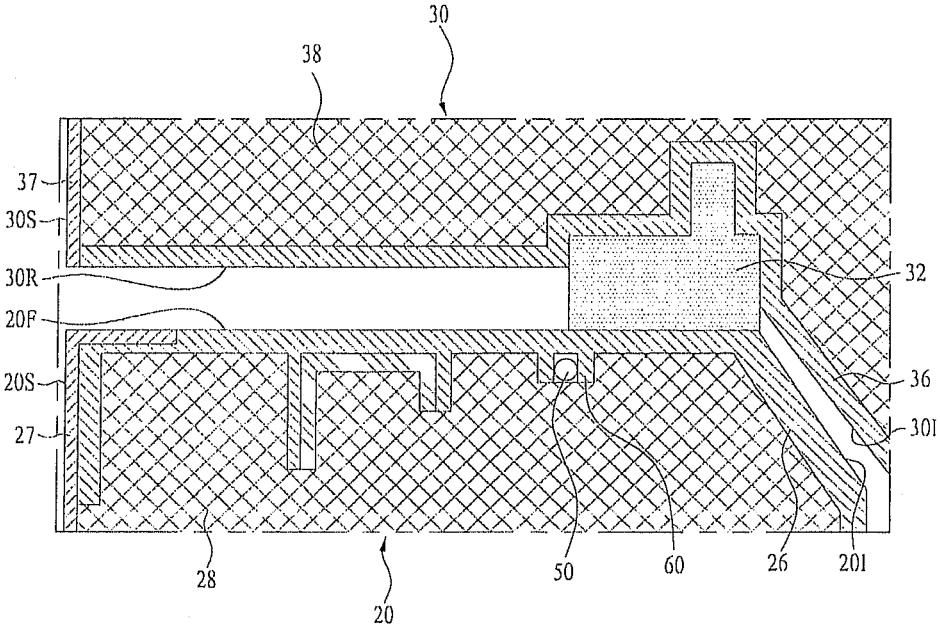
FIG. 4 is an enlarged sectional view showing part A of FIG. 3.

FIG. 4 is an enlarged sectional view of a portion of the main door 20 and the sub door 30 at which the heater 50 installed, in particular at the inside of a door liner 26 of the main door 20, just outside of a region thereof contacting the gasket 32.

Generally, a door may include an outer door formed of a sheet material, and a door liner formed of acrylonitrile butadiene styrene copolymer (ABS) resin. The outer door and the door liner may together define the external surface of the door. A space formed therebetween may be filled with a foam for heat insulation.

For example, an internal space defined by the door liner 26 and the outer door 27 of the main door 20 shown in FIG. 4 is filled with foam 28. In the same manner, an internal space defined by a door liner 36 and an outer door 37 of the sub door 30 may be filled with foam 38.

As shown in FIG. 4, a heater mounting part 60 may be provided at the front surface 20F of the main door 20 on an inside the door liner 26. The heater 50, which may be, for example, a heating wire, is mounted in the heater mounting part 60.

The heater 50 may be positioned adjacent to the front surface 20F of the main door 20, at the periphery of the gasket 32, as condensation is most easily formed in this area.

In a case in which the heater 50 is installed in this manner, the heater 50 consumes power, thus increasing overall power consumption of the refrigerator. Also, heat generated by the heater 50 may be transferred to the storage compartment, thus increasing heat load of the storage compartment. Additionally, in a case in which the width of the sub door 30 is equal to that of the main door 20, a larger amount of condensation may be formed than in a case in which the width of the sub door 30 is less than that of the main door, thus further increasing power consumption and heat transfer.

Figure 5:
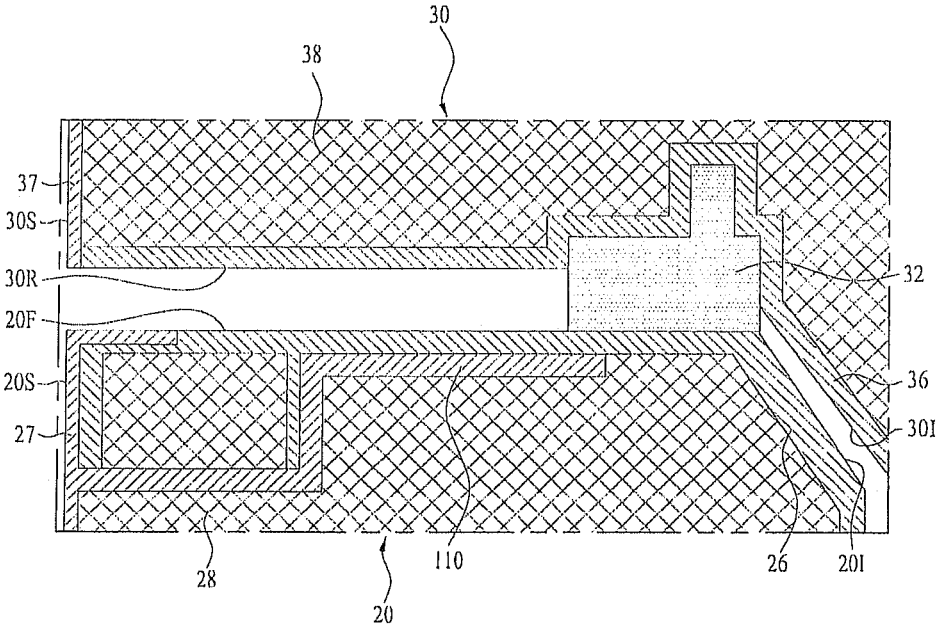
FIG. 5 is a sectional view of mating surfaces of a main door and a sub door of a refrigerator in accordance with an embodiment as broadly described herein.

FIG. 5 is a sectional view of mating surfaces of the main door 20 and the sub door 30 of a refrigerator in which a metal plate constituting an outer side of the main door 20 extends to a gasket contact portion along the inside of the front side of the main door 20, in accordance with an embodiment as broadly described herein.

As shown in FIG. 5, the main door 20 includes the rear surface 20R, the side surface 20S and the front surface 20F, and the sub door 30 includes the rear surface 30R, the side surface 30S and the front surface 30F. The gasket 32 may be provided along the edge of the rear surface 30R of the sub door 30 so as to contact the front surface 20F of the main door 20. Alternatively, the gasket 32 may be provided on the front surface 20F of the main door 20. A heat transfer member 110 or 120 (see FIG. 6) may extend from the inside of the side surface 20S to the inside of the front surface 20F of the main door 20 to conduct heat from the side surface 20S of the main door 20 to the front surface 20F of the main door 20, with which the gasket 32 selectively comes into contact, to prevent condensation from being formed on the front surface 20F of the main door 20.

As discussed above, the exemplary refrigerator shown in FIG. 1 may include refrigerator and freezer compartments opened and closed by a freezer compartment door 10 and a refrigerator compartment door 20 rotatably mounted to the freezer compartment and the refrigerator compartment, respectively, by hinges 13 and 23. A sub door 30, or auxiliary door 30 may be rotatably coupled to the refrigerator compartment door 20 by hinges 33, with a width of the sub door 30 being substantially equal to that of the main door 20.

The description herein has been directed mainly to a side by side type refrigerator. However, it is understood that these features may be applied to other types of refrigerators having a main door for opening and closing a storage compartment and a sub door for opening and closing an additional receiving compartment provided at the main door, and the width of the sub door is almost equal to that of the main door. The position of the main door and the sub door on the refrigerator may be adjusted as appropriate.

As previously discussed with respect to FIGS. 2 and 4, the gasket 32 is provided along the inside of the door liner 36 of the sub door 30 to contact the front surface 20F of the main door 20 to seal the refrigerator compartment and the receiving compartment between the main door 20 and the sub door 30 when the sub door 30 closes the main door 20.

That is, when the sub door 30 comes into contact with the main door 20, the gasket 32 comes into tight contact with the front surface 20F of the main door 20. As shown in FIG. 5, a heat transfer member 110 may extend from the inside of the side surface 20S of the main door 20 to a region of the inside of the front surface 20F of the main door 20 with which the gasket 32 comes into contact.

The outer door 27 of the main door 20 may be formed of a metal sheet, particularly a steel sheet. In the same manner, the heat transfer member 110 may also be formed of a steel sheet. The heat transfer member 110 may be integrally formed with the outer door 27 of the main door 20. Alternatively, the heat transfer member 110 may be separately formed, and then the heat transfer member 110 may be connected to the outer door 27. The heat transfer member 110 may be formed at the front surface 20F of the main door 20, extending along the inside of the door liner 26.

Figure 6:
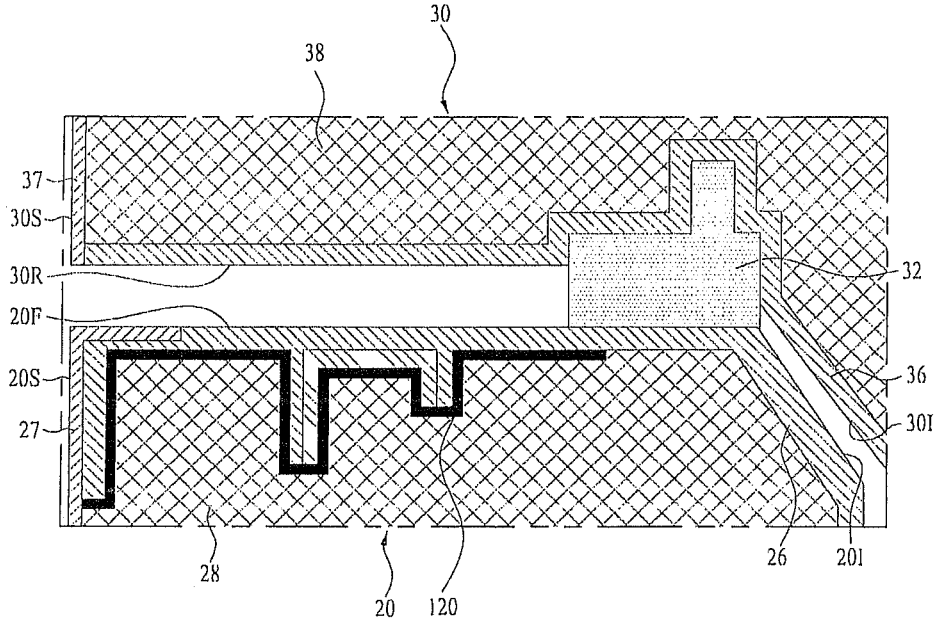
FIG. 6 is a sectional view of mating surfaces of a main door and a sub door of a refrigerator in accordance with an embodiment as broadly described herein.

FIG. 6 is a sectional view of mating surfaces of the main door 20 and the sub door 30 of a refrigerator in which a metal tape extends from an outer side of the main door to a gasket contact portion along the inside of a front surface of the main door, in accordance with an embodiment as broadly described herein.

The refrigerator shown in FIG. 6 is different from the refrigerator shown in FIG. 6 in that a heat transfer member 120 is formed as a separate heat transfer body 120 connected to the outer side of the main door 20.

Although the heat transfer member 110 shown in FIG. 5 may be formed separately from the outer door 27 of the main door 20 and then connected to the outer door 27 of the main door 20, the heat transfer member 110 is formed of the same material as the outer door 27, i.e. the steel sheet. The heat transfer member 120 shown in FIG. 6 may be formed of a different from that of the outer door 27.

In particular, the heat transfer member 120 shown in FIG. 6 may be a metal tape extending along the inside of the door liner 26 constituting the front surface 20F of the main door 20, and may include one or more bent portions.

In a case in which the heat transfer member 120 is configured in the form of a metal tape, the heat transfer member 120 may be cut and attached to a required region of the inside of the door liner 26 during manufacturing of the refrigerator door, thereby simplifying manufacture of the door. The metal tape may be made of, for example, an aluminum material. Since aluminum exhibits relatively high thermal conductivity and ductility, aluminum may be readily provided in tape form.

Figure 7:
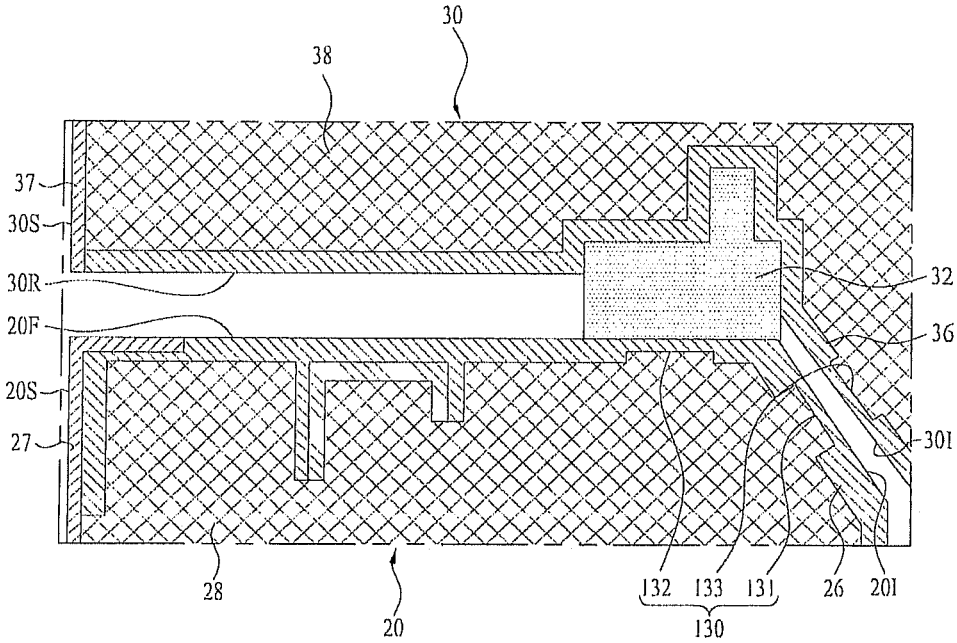
FIG. 7 is a sectional view of mating surfaces of a main door and a sub door of a refrigerator in accordance with an embodiment as broadly described herein.

FIG. 7 is a sectional view of mating surfaces of a main door 20 and a sub door 30 of a refrigerator in which the thickness of a portion of a door liner forming facing inclined surfaces is varied, in accordance with an embodiment as broadly described herein.

In the embodiment shown in FIG. 7, the heat transfer member is not provided at the inside of the door liner 26 of the main door 20. Rather, the door liner 24 forms a heat blocking part 130 at an inside of the position of the gasket 32 for minimizing the transfer of cool air in the storage compartment.

That is, a portion of the inner side of the main door 20 forms the inclined surface 20I, and the portion of door liner 26 constituting the inclined surface 20I includes a heat blocking part 130 formed so that the thickness of one portion of the inclined surface 20I is less than that of remaining portions of the inclined surface 20I.

The heat blocking part 130 may be formed so that the thickness of a portion of the door liner 26 constituting the inclined surface 20I of the main door 20 is less than that of the remaining portion of the door liner 26 to prevent cool air inside the storage compartment from being transferred to the outside of the gasket 32 via the door liner 26.

In certain embodiments, plurality of heat blocking parts 130 may be provided. Hereinafter, the heat blocking part formed in at the inclined surface 20I of the main door 20 will be referred to as a first heat blocking part 131.

The first heat blocking part 131 may be formed at a portion of the door liner 26 constituting the inclined surface 20I of the main door 20. Cool air from the storage compartment comes into direct contact with this portion of the door liner 26, thus cooling this portion of the door liner 26. However, the gap between the portion of the door liner 26 constituting the inclined surface 20I of the main door 20 and the facing inclined surface 30I of the sub door 30 is relatively narrow, and therefore, a degree at which cool air from the storage compartment is conducted via the door liner 26 may be greater than a degree of cooling achieved by direct contact with cool air.

Consequently, the portion of the door liner 26 constituting the inclined surface 20I of the main door 20 may be formed so that its thickness is equal to or less than half that of the remaining portion of the door liner 26 to minimize conduction of cool air via the door liner 26.

The thickness of the first heat blocking part 131 may be reduced by forming a groove at the inside of the door liner 26. In this case, the door may have a smooth external appearance after assembly of the door.

The door liner 26 constituting the front surface 20F of the main door 20 may also include a second heat blocking part 132 formed so that the thickness of a portion thereof contacting the gasket 32 is less than that of remaining portions of the door liner 26.

Cool air in the storage compartment is not directly transferred to the portion of the door liner 26 tightly contacting the gasket 32, but the cool air may be transferred to the outside through thermal conduction of the door liner 26. For this reason, a groove may be formed inside the portion of the door liner 26 tightly contacting the gasket 32 to reduce the thickness of this portion of the door liner 26 while having a flat external appearance.

Also, the rear surface 30R of the sub door 30 may include the inclined surface 30I opposite the inclined surface 20I of the main door 20. The door liner 36 may extend to the inclined surface 30I of the sub door 30 and face the first heat blocking part 131 with a third heat blocking part 133 whose thickness is less than that of the remaining portion of the inclined surface 30I.

As described, the door liner 26 of the main door 20 includes the inclined surface 20I, and the door liner 36 of the sub door 30 also includes the inclined surface 30I.

Condensation is mainly formed at the portion of the front surface 20F of the main door 20 contacting the gasket 32. However, condensation may be formed at the rear surface 30R of the sub door 30 outside the gasket 32 due to a temperature difference between the inside and the outside.

For this reason, the third heat blocking part 133 is formed at the portion of the door liner 36 constituting the inclined surface 30I of the sub door 30, to prevent condensation from being formed at the rear surface 30R of the sub door 30 outside the gasket 32.

Although the heat transfer member 110 or 120 is not shown in embodiment shown in FIG. 7, it will be understood that the heat blocking part 130 of the third embodiment may be provided along with the heat transfer member 110 or 120.

Consequently, cooling by cool air in the storage compartment may be restrained by the heat blocking part 130 and heat transfer from the outside via the heat transfer member 110 or 120 may be accelerated, thereby more effectively preventing condensation from being formed on the outer surface of the door liner 26.

As shown in FIGS. 1 to 3, the sub door 30 may be formed such that at least a portion of the sub door 30 has the same plane as, or is co-planar to, a corresponding portion of the main door 20.

The refrigerator is configured so that the width of the sub door 30 is substantially equal to that of the main door 20, the height of the sub door 30 is less than that of the main door 20, and the top of the sub door 30 and the top of the main door 20 are co-planar.

The gasket 32 is provided along the edge of the rear surface 30R of the sub door 30 in a rectangular shape. The heat transfer member 110 or 120 may be provided to transfer heat from the top of the sub door 30 as well as from the side of the sub door 30.

In a case in which at least one side of the sub door 30 has the same plane as a corresponding side of the main door 20, therefore, the at least one side of the sub door 30 may be the top or bottom of the sub door 30 as well as opposite sides of the sub door 30.

A refrigerator as embodied and broadly described herein may effectively prevent dew, or moisture/condensation, from being formed at a portion of the front surface of the main door contacting the gasket.

Also, in a refrigerator as embodied and broadly described herein, an additional heater for preventing formation of moisture/condensation may not be required at the inside of the door liner, but a heat transfer member may be structurally formed, thereby efficiently preventing formation of moisture/condensation.

Also, in a refrigerator as embodied and broadly described herein heater may reduce power consumption and prevent heat from the heater from penetrating into the storage compartment of the refrigerator.

A refrigerator as embodied and broadly described herein may include a main door and a sub door that rotatably open and close a storage compartment, and may have a structure to prevent dew from being formed at a front part of the main door.

A refrigerator as embodied and broadly described herein may be capable of efficiently preventing dew from being formed by the structure of a door without installation of an additional heater.

A refrigerator as embodied and broadly described herein may include a refrigerator body having at least one storage compartment defined therein, the refrigerator body being provided at the front thereof with an opening, a main door for opening and closing the storage compartment, the main door being provided at a front thereof with an opening, the main door having a receiving compartment provided separately from the storage compartment, the main door having a rear part, a side part, and a front part, a sub door provided to open and close the opening of the main door, the sub door having a rear part, a side part, and a front part, a gasket provided along an edge of the rear part of the sub door, the gasket coming contact with the front part of the main door to seal the interior of the main door when the sub door is closed, and a heat transfer member extending from the inside of the side part to the inside of the front part of the main door to conduct heat from the side part of the main door to the front part of the main door, with which the gasket selectively comes into contact, so that dew is prevented from being formed on the front part of the main door.

The heat transfer member may be formed by extending an outer door, made of a metal material, constituting an outside of the side part of the main door to the front part of the main door, with which the gasket selectively comes into contact.

The heat transfer member may extend to an inside of the front part of the main door.

The heat transfer member may include an separate heat transfer body connected to an outer side part of the main door.

The heat transfer member may include a metal tape extending along the inside of a door liner constituting the front part of the main door in a bent state.

The metal tape may be made of an aluminum material.

A portion of an inner side part of the main door may form an inclined surface, and a door liner constituting the inclined surface of the main door may include a first heat blocking part formed so that the thickness of a portion of the inclined surface is less than that of the remaining portion of the inclined surface.

A door liner constituting the front part of the main door may include a second heat blocking part formed so that the thickness of a portion contacting the gasket is less than that of the remaining portion of the door liner.

The rear part of the sub door may include an inclined surface opposite to the inclined surface of the main door, and a door liner constituting the inclined surface of the sub door may be provided at a position opposite to the first heat blocking part with a third heat blocking part formed so that the thickness of a portion of the inclined surface is less than that of the remaining portion of the inclined surface.

The sub door may be formed such that at least one side of the sub door has the same plane as a corresponding side of the main door.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a refrigerator body having at least one storage compartment defined therein, and a main opening provided at a front thereof corresponding to the at least one storage compartment;

a main door coupled to the refrigerator body for opening and closing the at least one storage compartment, the main door having an auxiliary opening provided at a front thereof and a receiving compartment provided separately from the at least one storage compartment;

an auxiliary door coupled to the main door to open and close the auxiliary opening;

a gasket provided along an edge of a rear surface of the auxiliary door so as to contact a front surface of the main door and form a seal there between when the auxiliary door is closed; and a heat transfer device provided in an interior space formed within the main door, wherein the heat transfer device extends from an inner surface of a side surface of the main door to an inner surface of a front surface of the main door, at a position corresponding to a contact area with the gasket, so as to conduct heat from the side surface of the main door to the front surface of the main door and prevent formation of condensation on an outer surface of the front surface of the main door, wherein the heat transfer device comprises a metal tape that extends along an inside surface of a door liner that defines the front surface of the main door, and wherein the main door liner further comprises a heat blocking part formed in the front surface of the main door, at the position corresponding to the contact area with the gasket, wherein a thickness of the main door liner at a portion thereof that forms the heat blocking part is less than that of remaining portions of the main door liner that form the front surface of the main door.

2. The refrigerator of claim 1, wherein the main door comprises an outer door made of a metal material and defining an exterior portion of the main door extending from the side surface of the main door to the front surface of the main door, and wherein the heat transfer device comprises an extension of the outer door that extends from the inner surface of the side surface of the main door into the interior space formed within the main door and along the inner surface of the front surface of the main door to the position corresponding to the contact area with the gasket.

3. The refrigerator of claim 1, wherein the heat transfer device comprises a separate heat transfer body connected to an outer surface of the side surface of the main door.

4. The refrigerator of claim 1, wherein the inside surface of the door liner comprises a plurality of bends, and wherein the metal tape conforms to the plurality of bends.

5. The refrigerator of claim 4, wherein the metal tape is made of an aluminum material.

6. The refrigerator according to claim 1, wherein the inclined surface comprises a second heat blocking part formed in the main door liner such that a thickness of the main door liner at a portion thereof at which the second heat blocking part is formed is less than that of remaining portions of the inclined surface.

7. The refrigerator of claim 6, wherein the auxiliary door comprises an auxiliary door liner that defines a rear surface of the auxiliary door, the rear surface of the auxiliary door comprising an inclined surface that is positioned opposite the inclined surface of the main door, and wherein a third heat blocking part is formed in the inclined surface of the auxiliary door liner of the auxiliary door, wherein a thickness of a portion of the auxiliary door liner at which the third heat blocking part is formed is less than that of remaining portions of the auxiliary door liner that form the inclined surface of the auxiliary door.

8. The refrigerator of claim 1, wherein at least one side of the auxiliary door is coplanar with a corresponding side of the main door.

9. The refrigerator of claim 8, wherein a width of the auxiliary door is substantially the same as a width of the main door.

10. A refrigerator, comprising:

a main body having a main storage compartment formed therein;

a main door coupled to the main body so as to open and close a main opening in the main body corresponding to the main storage compartment, wherein the main door has an auxiliary storage compartment formed therein that is separate from the main storage compartment;

an auxiliary door coupled to the main door so as to open and close an auxiliary opening formed in the main door corresponding to the auxiliary storage compartment;

a gasket positioned between mating surfaces of the main door and the auxiliary door so as to form a seal there between when the auxiliary door is closed against the main door; and a heat transfer device provided in an interior space formed within the main door, wherein the heat transfer device extends into the interior space from a lateral side of the interior space and along a front side of the interior space to a position corresponding to a point at which the gasket contacts the main door, wherein the main door further comprises, an outer door positioned at a first edge of the front surface of the main door so as to define a first side surface of the main door, a main door liner coupled to the outer door, the main door liner defining a second side surface of the main door at a second edge of the front surface opposite the first edge thereof, wherein the second side surface forms an inclined surface, and a heat blocking part formed in an interior side of the main door liner that forms the front surface of the main door, at a position corresponding to the point at which the gasket contacts the main door.

11. The refrigerator of claim 10, wherein the auxiliary door comprises an auxiliary door liner, comprising:

a rear surface of the auxiliary door facing the front surface of the main door;

a first side surface of the auxiliary door formed at a first edge of the rear surface of the auxiliary door corresponding to the first edge of the front surface of the main door; and a second side surface of the auxiliary door formed at a second edge of the rear surface of the auxiliary door corresponding to the second edge of the front surface of the main door, wherein the second side surface of the auxiliary door forms an inclined surface that corresponds to the inclined surface of the main door.

12. The refrigerator of claim 11, wherein the main door liner further comprises:

second heat blocking part formed in an interior side of the main door liner that forms the inclined surface of the main door, wherein a thickness of the main door liner at the second heat blocking part is less than that of remaining portions of the main door liner that form the inclined surface of the main door.

13. The refrigerator of claim 12, wherein the auxiliary door liner further comprises:

a third heat blocking part formed in an interior side of the auxiliary door liner that forms the inclined surface of the auxiliary door, wherein a thickness of the auxiliary door liner at the third heat blocking part is less than that of remaining portions of the auxiliary door liner that form the inclined surface of the auxiliary door.

14. The refrigerator of claim 10, wherein an interior surface of the main door liner includes a plurality of bends, and wherein the heat transfer member comprises a metal tape that is adhered to the interior surface of the main door liner and conforms to the plurality of bends.

15. The refrigerator of claim 10, wherein the heat transfer device comprises an extension of the outer door that extends from an interior side of the first side surface of the main door defined by the outer door, into the interior space formed within the main door, and along an interior side of the main door liner that defines the front surface of the main door to the position corresponding to the point at which the gasket contacts the main door.

* * * * *